US005665047A

United States Patent [19]

Brimhall

[11] Patent Number: 5,665,047

[45] Date of Patent: Sep. 9, 1997

[54] MULTIPLE FUNCTION CENTRIFUGE APPARATUS WITH INDEX PLATE AND METHOD

[75] Inventor: Owen D. Brimhall, South Jordan, Utah

[73] Assignee: Technical Research Associates, Inc., Salt Lake City, Utah

[21] Appl. No.: 726,244

[22] Filed: Oct. 4, 1996

[51] Int. Cl.[6] ..... B04B 5/02

[52] U.S. Cl. ..... 494/16; 494/37

[58] Field of Search ..... 494/10, 12, 16, 494/33, 37, 84, 85; 422/72

[56] References Cited

U.S. PATENT DOCUMENTS

| | | | |
|---|---|---|---|
| 3,819,111 | 6/1974 | Romanauskas et al. | 494/16 |
| 3,970,245 | 7/1976 | Aeschlimann | 494/12 X |
| 4,412,830 | 11/1983 | Strain et al. | 494/12 |

*Primary Examiner*—Charles E. Cooley
*Attorney, Agent, or Firm*—J. Winslow Young

[57] ABSTRACT

A multiple function centrifuge for use in the centrifugation of sets of centrifugation containers within preselected size ranges and centrifugation speeds. The centrifuge rotor is configured with a plurality of receptacle sets therein, each set having a preselected size to receive the corresponding size of centrifugation container. An index plate has a single set of access ports therethrough. The orientation of the access ports is coordinated with the placement of the receptacle sets to limit placement of centrifugation containers to a single receptacle set. Once a particular size of centrifugation container has been selected and inserted into the appropriate receptacle in the rotor, the index plate automatically blocks placement of centrifugation containers into any other receptacle. The motor is a multispeed motor to allow the operator to select the appropriate centrifugation speed and duration as a function of the liquid undergoing centrifugation.

17 Claims, 3 Drawing Sheets

MULTIPLE FUNCTION CENTRIFUGE APPARATUS WITH INDEX PLATE AND METHOD

BACKGROUND

1. Field of the Invention

This invention relates to centrifuge apparatus and, more particularly, to a multiple function centrifuge apparatus and method for the selective centrifugation of a plurality of samples having a preselected sample size selected from a range of sample sizes at predetermined speeds of rotation and for predetermined periods of time.

2. The Prior Art

The centrifugation of various types of liquid suspensions is a very important step in the analysis of the constituents of the liquid suspension. For example, a number of diagnostic procedures require the centrifugation of samples of body fluids in order to determine the proper treatment protocol. As one illustrative example, if a physician suspects a patient is suffering from, say, a bladder infection the physician will order the analysis of a urine specimen from that patient. A portion of the urine specimen is subjected to centrifugation so that any bacteria present in the urine will be agglomerated in the bottom of the centrifugation tube where it can then be retrieved and analyzed. If it were not for centrifugation, any microorganisms in the urine may be too dispersed to enable the laboratory technician to readily identify, first, the presence of microorganisms in the urine and, second, the type of microorganism so that the proper treatment protocol can be established. Analysis of blood is also another important diagnostic procedure and is significantly enhanced through centrifugation. Perhaps one of the most vital aspects of blood analysis is that analysis done at the site of an accident, battlefield injury, or the like, wherein a prompt, accurate analysis of the blood is critical to the ultimate survival of the victim. This prompt, accurate analysis is made possible with the assistance of centrifugation.

Historically, the centrifugation of body fluids such as blood has required the use of sophisticated, expensive equipment suitable for use only in a laboratory environment. Further, different centrifugation requirements necessitated the use of different centrifugation equipment. As such, it was highly impracticable to expect to use this type of centrifugation equipment at the scene of a remote accident especially if one is expected to process a variety of body fluid samples in various quantities and under different centrifugation speeds.

In view of the foregoing it would be an advancement in the art to provide a centrifugation apparatus that is portable and configured to process a variety of sample containers having a preselected range of sizes and with each size within the range requiring a different centrifugation protocol. It would also be an advancement in the art to provide a multiple function centrifuge apparatus having a rotor with a plurality of sets of receptacles therein, each set of receptacles being configured to receive a corresponding set of centrifugation containers. It would also be an advancement in the art to provide a index plate for the rotor wherein a single set of holes in the index plate keys the underlying receptacles in the rotor to restrict the placement of centrifugation containers to a single set of centrifugation containers. Such a novel centrifugation apparatus and method is disclosed and claimed herein.

BRIEF SUMMARY AND OBJECTS OF THE INVENTION

This invention is a novel centrifugation apparatus and method for the centrifugation of preselected sizes of centrifugation containers and at predetermined centrifugation speeds and for preselected periods of time all with the same centrifuge apparatus. The centrifuge rotor is designed with a plurality of sets of receptacles, each set of receptacles being configured to receive a specific size of centrifugation container. An index plate is provided for the rotor and has a single set of ports therethrough. The placement of the ports in the index plate provides a keying mechanism for restricting access to a single set of receptacles in the rotor at any given time. The centrifuge apparatus is program operated to select the correct speed and duration of rotation of the rotor as a function of the size and contents of the centrifugation containers being processed.

It is, therefore, a primary object of this invention to provide improvements in centrifugation apparatus, particularly in multiple function centrifugation apparatus.

Another object of this invention is to provide improvements in the method of processing samples by centrifugation.

Another object of this invention is to provide a centrifuge rotor with a plurality of sets of receptacles, each set of receptacles being configured to receive a predetermined size of centrifugation container.

Another object of this invention is to provide an index plate having a single set of access ports therethrough, the placement of the ports restricting access to the receptacles in the rotor to a single set of receptacles.

Another object of this invention is to provide a centrifuge apparatus that is programmable for different rates of rotations and duration of rotation as a function of the material undergoing centrifugation.

These and other objects and features of the present invention will become more readily apparent from the following description and the appended claims.

DETAILED DESCRIPTION OF THE PREFERRED EMBODIMENT

Figure 1:
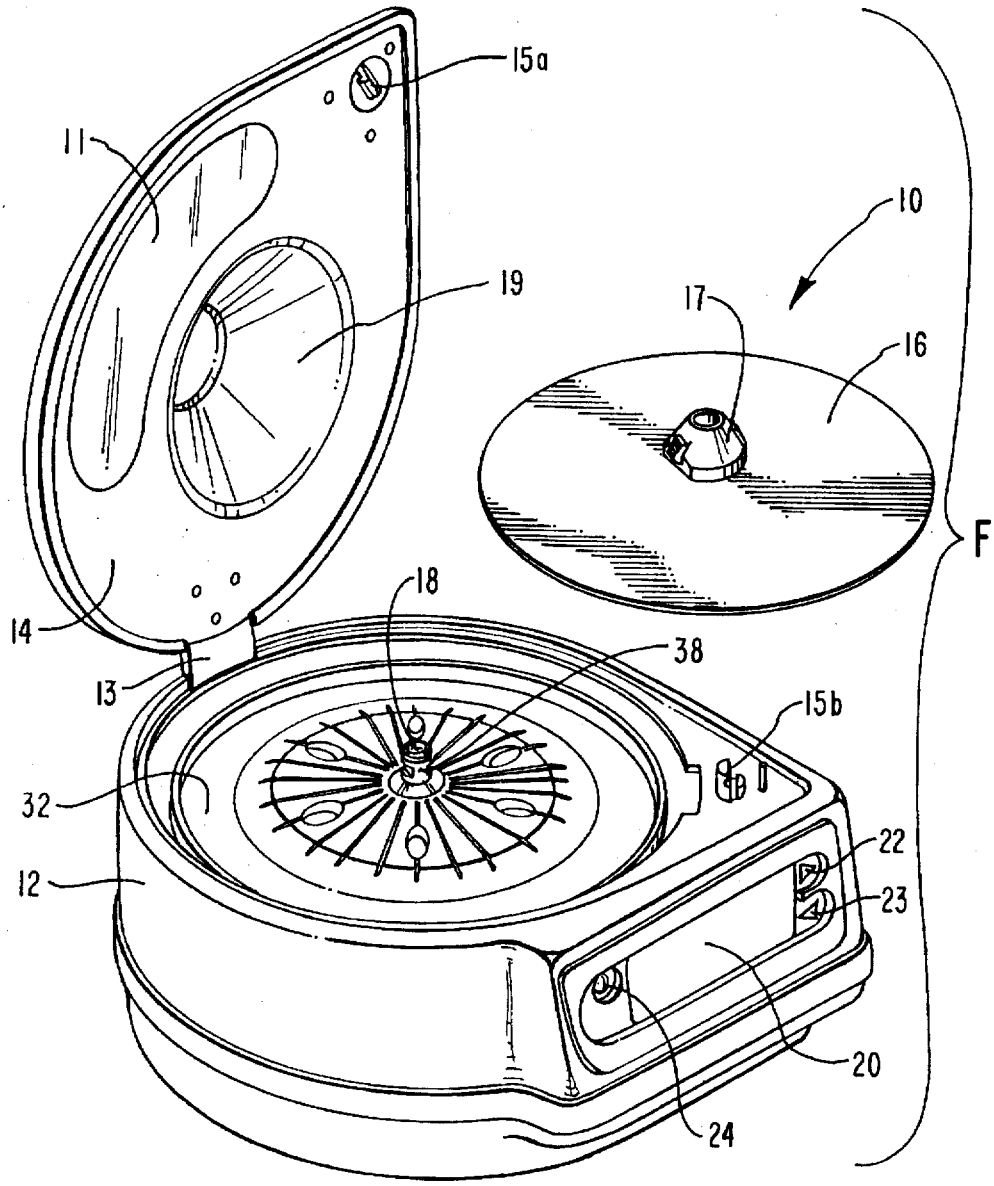
FIG. 1 is a partially exploded, perspective view of a presently preferred embodiment of the novel, multiple function centrifuge apparatus of this invention, showing the lid raised and the closure removed.

The invention is best understood from the following description with reference to the drawing wherein like parts are designated with like numerals throughout and taken in conjunction with the appended claims.

General Discussion

The novel multiple function centrifuge apparatus of this invention is specifically designed as a relatively compact centrifuge that uniquely can be used to provide centrifugation of a wide array of biological samples using commercially available, disposable centrifugation tubes. The centrifuge includes automatic settings for the centrifugation of samples to determine microhematocrit, Quantitative Buffy Coat (QBC) analysis, fecal sedimentation, urine sedimentation, plasma preparation, and other, user-selectable manual operational settings. The rotor includes multiple sets of tube holders access to which is regulated by an index plate having a single of set of access ports therethrough. The single set of access ports is specifically aligned to key a single set of receptacles in the rotor once a specific receptacle in the rotor has been selected. This unique feature precludes the operator from inadvertently placing centrifugation tubes in receptacles of differing receptacle sets.

A Liquid Crystal Display (LCD) displays the various menu selections available to the user and can even be programmed to display the information in any preselected language. Once a particular selection has been made the system automatically sets the rotation speed and duration for the particular type of sample being processed.

The entire centrifuge of this invention is compact, lighter in weight than any comparable centrifuge apparatus, and is ruggedized to resist shock and vibration damage to its components. All of these features readily adapt this novel centrifuge apparatus and method highly suitable for use by emergency response teams and even by combat medical personnel.

Detailed Description

Referring now to FIG. 1, the novel, multifunction centrifuge apparatus of this invention is shown generally at 10 and includes a housing 12 having a lid 14 hingedly joined to housing 12 at a hinge 13. Centrifuge 10 is configured as a hand-portable unit weighing less than about three kilograms and is designed to be mountable upon an auxiliary battery pack (not shown) for field operations. Lid 14 includes a latch 15*a* that engages a corresponding catch 15*b* on housing 12. Lid 14 also has an upwardly oriented dome 19 as well as a viewing window 11 to allow the operator (not shown) to peer inside centrifuge 10. A cover plate 16 is removably mountable in housing 12 to the upper end of a rotor shaft 18 by an interlock 17 on cover plate 16. Rotor shaft 18 extends upwardly from a motor 54 (FIG. 3) inside housing 12 and rotatably supports a rotor 30 (FIG. 2) and an index plate 32. A control panel 20 on the face of housing 12 is configured as a liquid crystal display (LCD) driven by a preprogrammed menu, selection of which is accomplished by touch plates 22 and 23. An on/off switch 24 activates the motor which, in turn, is controlled by the particular menu selection displayed on control panel 20.

Figure 2:
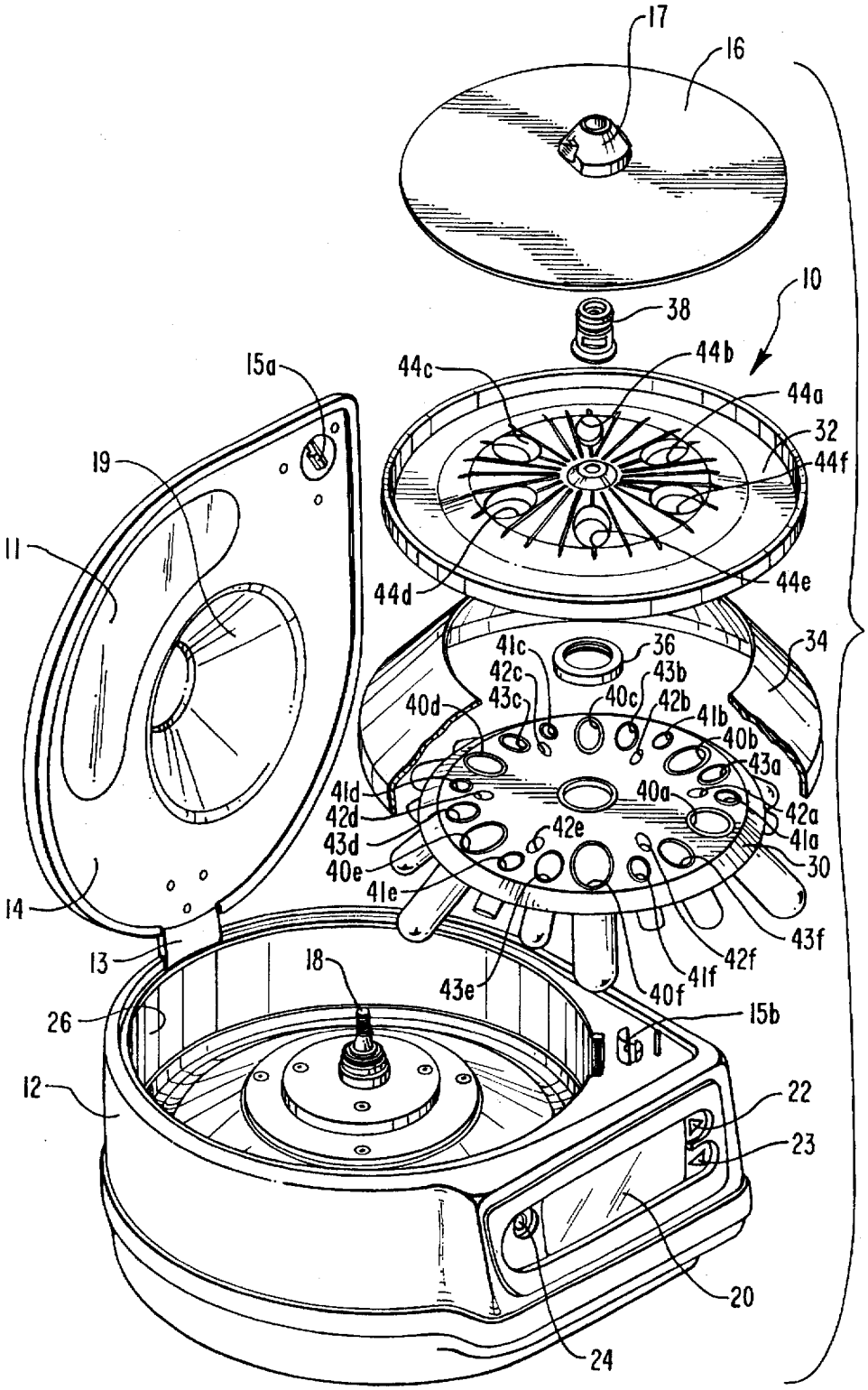
FIG. 2 is an exploded, perspective view of the various internal components of the multiple function centrifuge apparatus of FIG. 1 and with a portion of the skirt assembly shown broken away for ease of understanding of the underlying rotor.

Referring now also to FIG. 2, housing 12 is shown having a chamber 26 with rotor shaft 18 extending upwardly from base of chamber 26. Chamber 26 is configured as a cylindrical hollow in housing 12 and serves as the enclosure for receiving therein all of the components that cooperate with rotor 30 when rotor 30 is rotatably mounted to rotor shaft 18. A locking nut 36 secures rotor 30 to rotor shaft 18. Rotor 30 is configured with a plurality of receptacle sets 40*a–f*, 41*a–f*, 42*a–f*, and 43*a–f* mounted thereto with the entrance to each of receptacle sets 40*a–f*, 41*a–f*, 42*a–f*, and 43*a–f* extending upwardly through the surface of rotor 30. A skirt 34 is configured with a frustoconical shape and mounted to and encloses the outer periphery of rotor 30.

Index plate 32 is rotatably mounted to rotor shaft 18 and is independently rotatable relative to rotor 30. Index plate 32 includes a set of index ports 44*a–f*, each of which is dimensionally coordinated with each of the respective individual receptacles that constitute receptacle sets 40*a–f*, 41*a–f*, 42*a–f*, and 43*a–f*. Specifically, when index plate 32 is rotated to place index ports 44*a–f* into alignment with any one of receptacle sets 40*a–f*, 41*a–f*, 42*a–f*, or 43*a–f* the orientation of index ports 44*a–f* is such that they preclude all access to any of the remaining receptacle sets. For example, if index ports 44*a–f* are aligned with, say, receptacle set 42*a–f*, then only the individual receptacles 42*a*, 42*b*, 42*c*, 42*d*, 42*e*, and 42*f* are accessible through the respective index ports 44*a*, 44*b*, 44*c*, 44*d*, 44*e*, and 44*f* to the exclusion of all other receptacles in receptacle sets 40*a–f*, 41*a–f*, and 43*a–f*. In this manner, index plate 32 effectively limits the placement of centrifugation containers (not shown) to any given size of centrifugation container designed for the respective specific receptacle set 41*a–f* through 43*a–f*. Clearly, of course, the operator (not shown) must exercise a certain degree of selectivity by assuring that the correct size of centrifugation container is placed in the correct size receptacle of receptacle sets 40*a–f* through 43*a–f*. Once the proper selection has been made, index plate 32 thereafter restricts placement of the centrifugation container to that particular set of preselected receptacles. In effect, therefore, index plate 32 provides a keying mechanism for keying rotor 30 to receipt of only one set of centrifugation containers at any given time, thus effectively precluding the inadvertent commingling of different sizes of centrifugation containers in the various receptacles of receptacle sets 40*a–f* through 43*a–f*.

A bushing 38 is mounted to rotor shaft 18 above index plate 32 and serves as a spacer to spatially separate cover plate 16 from index plate 32. Correspondingly, a lock ring 36 is secured to the base of rotor shaft 18 to releasably engage rotor 30 to rotor shaft 18. Lock ring 36 also allows index plate 32 to rotate freely relative to rotor 30 thus allowing the operator to selectively key index ports 44*a–f* to any one of the preselected receptacle sets 40*a–f* through 43-*a–f*. Clearly, of course, once a particular centrifuge tube has been inserted through one of index ports 44*a–f* then that selection mandates that the remaining centrifuge tubes will be directed into the correct, underlying set of receptacle sets 40*a–f* through 43*a–f*.

Figure 3:
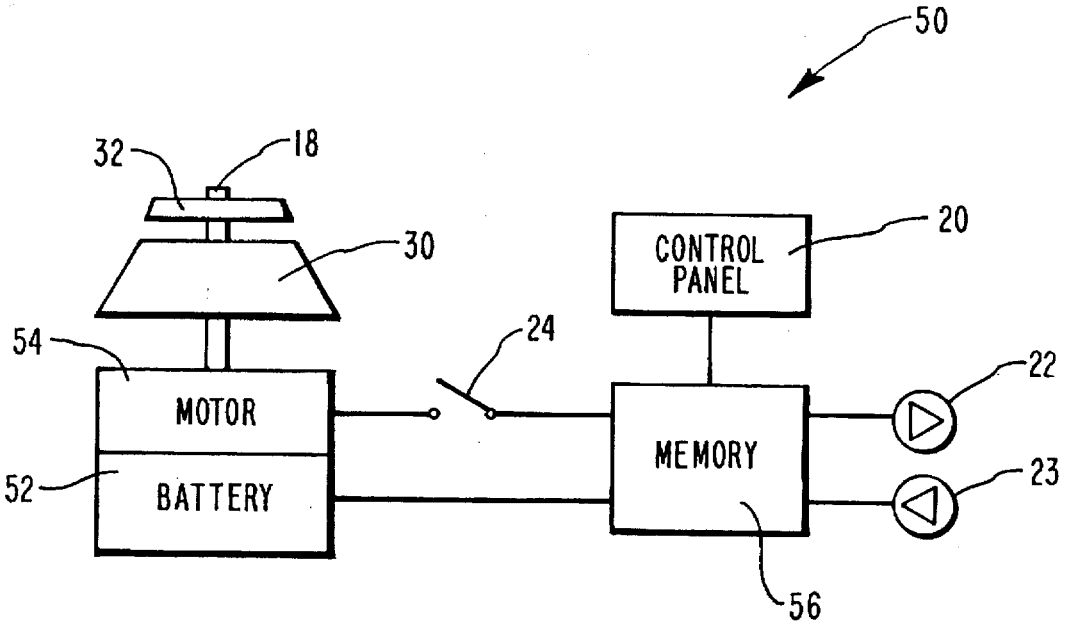
FIG. 3 is a schematic diagram of the internal components of the multiple function centrifuge of FIGS. 1 and 2.

Referring now to FIG. 3, the internal components of multiple function centrifuge 10 of FIGS. 1 and 2 are shown schematically generally at 50 and include a battery 52, a motor 54, and a memory 56. Rotor shaft 18 extends upwardly from motor 54 and has rotor 30 affixed thereto to enable motor 54 to rotate 30. Index plate 32 is rotatably mounted to rotor shaft 18 so as to provide the novel keying features of index plate 32 to rotor 30 as has been described in detail hereinbefore. Battery 52 supplies the necessary electrical energy for the operation of memory 56, display 20 (FIGS. 1 and 2), and motor 54. As the name implies, memory 56 is preprogrammed with the necessary instructions for the operation of motor 54 as displayed on control panel 20. In particular, memory 56 is preprogrammed with all of the necessary operating instructions necessary to enable the operator (not shown) to operate multiple function centrifuge 10.

Operation of multiple function centrifuge 10 is commenced by the operator pressing either of touch plates 22 or 23 which causes memory 56 to display the starting sequence on control panel 20. This starting sequence is actually a menu through which the operator is able to scroll using touch plates 22 or 23 for forward or reverse respectively. Once the desired item on the menu has been selected the operator simply follows the instructions thus displayed on control panel 20 which includes inserting the centrifuge containers (not shown) through index plate 32 into the appropriate receptacle sets, receptacle sets 40*a–f* through 43*a–f*, as determined by index plate 32 and as instructed by display panel 20. Thereafter, cover plate 16 is mounted to rotor shaft 18 and lid 14 is then closed. The operator then closes switch 24 to enable memory 56 to take over the operation of motor 54 both as to its speed of rotation and the duration of the centrifugation cycle. Upon completion of each centrifugation cycle memory 56 stops motor 54 and displays the necessary instructions on control panel 20 to enable the operator to continue the diagnostic procedure for that particular set of centrifugation samples. Advantageously, the operator is able to simply scroll through the menu displayed on control panel 20 and select another centrifugation protocol involving another type of biological sample by the simple step of placing the centrifugation tubes in the appropriate receptacle sets 40*a–f* through 43*a–f* while using index plate 32 to assure that only one of receptacle sets 40*a–f* through 43*a–f* is in use at any one time.

The Method

In practicing the novel method of this invention the operator (not shown) selectively presses touch plate 22 or 23 to scroll through the menu selections for the particular type of sample being processed in centrifuge apparatus 10. The menu selection made as shown on control panel 20 will instruct the operator as to the placement of the centrifuge tubes (not shown) in the preselected receptacle set 40*a–f* through 43*a–f*. With the centrifuge tubes thus placed in rotor 30, the operator places cover plate 16 on rotor shaft 18 while engaging interlock 17 thereto. Lid 14 is then closed with latch 15*a* in engagement with catch 15*b*. With lid 14 properly closed the operator then presses on/off switch 24 to activate centrifuge 10. The operation of centrifuge 10 then proceeds according to the menu selection shown on the LCD of control panel 20.

Importantly, index plate 32 reduces the likelihood that the centrifuge tubes will be misplaced among the various receptacles of receptacle sets 40*a–f* through 43*a–f*. For example, even though receptacle sets 40*a–f* through 43*a–f* are each of a preselected size, in the absence of index plate 32 it could be possible for the operator to inadvertently place a centrifuge tube in, say, receptacle 41*f* and also in receptacle 43*c* with the result that a significant imbalance would be created in rotor 30. However, the placement of index ports 44*a–f* is such that once a particular receptacle set 40*a–f* through 43*a–f* is indexed thereby, access to all other receptacle sets 40*a–f* through 43*a–f* is blocked by index plate 32.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A multiple function centrifuge comprising:

a housing:

a chamber in said housing;

a rotor shaft extending into said chamber;

a rotor mounted to said rotor shaft in said chamber, said rotor including a plurality of receptacle sets, each of said receptacle sets being configured to receive a centrifuge container having a predetermined size; and an index plate rotatably mounted to said rotor shaft, said index plate having a single set of access ports, the orientation of said access ports being coordinated with the orientation of said plurality of receptacle sets to thereby limit access to a single receptacle set at a time of said plurality of receptacle sets.

2. The multiple function centrifuge defined in claim wherein said chamber includes a cover plate for enclosing said index plate inside said chamber.

3. The multiple function centrifuge defined in claim 2 wherein said housing includes a lid for said chamber, said lid enclosing said cover plate in said chamber.

4. The multiple function centrifuge defined in claim 1 wherein said housing includes a memory having a preprogrammed menu for controlling said rotor.

5. The multiple function centrifuge defined in claim 4 wherein said housing includes a control panel for displaying preselected portions of said preprogrammed menu.

6. The multiple function centrifuge defined in claim 5 wherein said control panel includes a touch plate means for scrolling through said menu displayed on said control panel.

7. The multiple function centrifuge defined in claim 1 wherein said housing includes a battery means for providing electrical energy to the.. electrical components contained in said housing.

8. A multiple function centrifuge comprising:

a housing;

a centrifuge chamber in said housing;

a motor in said housing at a position below said centrifuge chamber;

a rotor shaft on said motor, said rotor shaft extending into said centrifuge chamber;

a rotor in said centrifuge chamber, said rotor being mounted to said rotor shaft to thereby accommodate said rotor being rotated by said motor;

a plurality of receptacle sets in said rotor, each receptacle set being configured to receive a predetermined size of centrifuge container;

an index plate rotatably mounted to said rotor shaft, said index plate having a single set of access ports therein, the orientation of said single set of access ports being selectively coordinated with the orientation of said plurality of receptacle sets in said rotor to thereby limit access to a single receptacle set at a time;

cover means for enclosing said rotor and said index plate in said centrifuge chamber; and control means for controlling said motor.

9. The multiple function centrifuge defined in claim 8 wherein said housing includes a battery means for supplying electrical energy to said motor.

10. The multiple function centrifuge defined in claim 8 wherein said control means includes memory means for supplying said control means with a selection of operational variables for operating said motor.

11. The multiple function centrifuge defined in claim 10 wherein said memory means includes a selector means for selecting said operational variables supplied by the memory means.

12. The multiple function centrifuge defined in claim 11 wherein said memory means includes display means for displaying said operational variables.

13. The multiple function centrifuge defined in claim 8 wherein said rotor includes a skirt mounted to said rotor.

14. A method for providing a centrifuge with a multiple function capability comprising the steps of:

obtaining a housing;

forming a centrifuge chamber in said housing;

selecting a motor having a motor shaft extending therefrom;

mounting said motor in said housing with said motor shaft extending into said centrifuge chamber;

forming a rotor for said centrifuge chamber, said rotor having a plurality of receptacle sets formed therein;

securing said rotor to said motor shaft;

preparing an index plate having a single set of apertures therethrough, said apertures restricting access to a single receptable set in said rotor;

rotatably attaching said index plate to said motor shaft; and selecting a preselected receptacle set in said rotor for receipt of a plurality of centrifuge tubes by indexing said index plate over said preselected receptacle set.

15. The method defined in claim 14 wherein said obtaining step includes placing a memory means in said housing, said memory means serving as a control means for said motor.

16. The method defined in claim 15 wherein said placing step includes coupling a display means to said memory means for displaying a readout from said memory.

17. The method defined in claim 16 wherein said coupling step includes interconnecting a touch plate means to said control means for the purpose of selecting a readout displayed on said display means.

* * * * *